US009833966B2

(12) United States Patent
Ohira et al.

(10) Patent No.: US 9,833,966 B2
(45) Date of Patent: Dec. 5, 2017

(54) WEB ADHESIVE APPLICATION DEVICE AND ADHESIVE APPLICATION METHOD AS WELL AS CARDBOARD SHEET MANUFACTURING DEVICE

(71) Applicant: MITSUBISHI HEAVY INDUSTRIES PRINTING & PACKAGING MACHINERY, LTD., Mihara-shi, Hiroshima (JP)

(72) Inventors: Kazuhito Ohira, Mihara (JP); Kazuki Mizushima, Mihara (JP); Toshihide Kato, Mihara (JP)

(73) Assignee: MITSUBISHI HEAVY INDUSTRIES PRINTING & PACKAGING MACHINERY, LTD., Hiroshima (JP)

( * ) Notice: Subject to any disclaimer, the term of this patent is extended or adjusted under 35 U.S.C. 154(b) by 264 days.

(21) Appl. No.: 14/646,157

(22) PCT Filed: Sep. 18, 2013

(86) PCT No.: PCT/JP2013/075139
§ 371 (c)(1),
(2) Date: May 20, 2015

(87) PCT Pub. No.: WO2014/080685
PCT Pub. Date: May 30, 2014

(65) Prior Publication Data

US 2015/0290899 A1 Oct. 15, 2015

(30) Foreign Application Priority Data

Nov. 26, 2012 (JP) ..... 2012-258024

(51) Int. Cl.
*B31F 1/28* (2006.01)
*B05C 1/08* (2006.01)
(Continued)

(52) U.S. Cl.
CPC ..... *B31F 1/2818* (2013.01); *B05C 1/0813* (2013.01); *B05C 1/0817* (2013.01);
(Continued)

(58) Field of Classification Search
None
See application file for complete search history.

(56) References Cited

U.S. PATENT DOCUMENTS 5,101,761 A 4/1992 Isowa et al.
5,518,573 A 5/1996 Schulz

FOREIGN PATENT DOCUMENTS

JP 63-63158 U 4/1988
JP 5-24346 U 3/1993
(Continued)

OTHER PUBLICATIONS

Machine translation of JP 05-138096.*
(Continued)

*Primary Examiner* — Barbara J Musser
(74) *Attorney, Agent, or Firm* — Hauptman Ham, LLP

(57) ABSTRACT

A web adhesive application device, adhesive application method, and the cardboard sheet manufacturing device are provided with: an adhesive liquid tank for storing an adhesive liquid; an adhesive application roll is configured for transferring the adhesive liquid to an adhesive application region adjusted according to a paper width of a bottom liner board to be glued together with a single face cardboard sheet; a doctor roller for adjusting the adhesive liquid to a set film thickness; scraping members in pressured contact with the surface of the adhesive application roll on the upstream side of the nip section with the doctor roller; and damming members in contact with the surface of the adhesive application roll on the upstream side of the nip section with the doctor roller in the rotation direction and on the downstream
(Continued)

side of the scraping member contact positions in the rotation direction.

17 Claims, 7 Drawing Sheets

(51) Int. Cl.

| | |
|---|---|
| ***B31F 5/04*** | (2006.01) |
| ***D21H 23/56*** | (2006.01) |
| ***D21H 25/08*** | (2006.01) |
| ***D21H 27/40*** | (2006.01) |
| ***B31F 1/24*** | (2006.01) |
| ***D21H 27/00*** | (2006.01) |

(52) U.S. Cl.
CPC ..... *B31F 1/24* (2013.01); *B31F 1/2804* (2013.01); *B31F 5/04* (2013.01); *D21H 23/56* (2013.01); *D21H 25/08* (2013.01); *D21H 27/00* (2013.01); *D21H 27/40* (2013.01)

(56) References Cited

FOREIGN PATENT DOCUMENTS

| | | | |
|---|---|---|---|
| JP | 5-138096 | A | 6/1993 |
| JP | 10-26251 | A | 1/1998 |
| JP | 10-29251 | A | 2/1998 |
| JP | 2813719 | B2 | 10/1998 |
| JP | 2006-69095 | A | 3/2006 |
| JP | 2011-212919 | A | 10/2011 |

OTHER PUBLICATIONS

Written Opinion dated Dec. 17, 2013, corresponding to PCT/JP2013/075139.
International Search Report and Written Opinion dated Dec. 17, 2013 in corresponding International Application No. PCT/JP2013/075139.
Office Action in JP Application No. 2012-258024, dated Aug. 30, 2016.

* cited by examiner

WEB ADHESIVE APPLICATION DEVICE AND ADHESIVE APPLICATION METHOD AS WELL AS CARDBOARD SHEET MANUFACTURING DEVICE

RELATED APPLICATIONS

The present application is a National Stage of PCT International Application No. PCT/JP2013/075139, filed Sep. 18, 2013, which claims the benefit of priority from Japanese Patent Application No. 2012-258024, filed Nov. 26, 2012.

TECHNICAL FIELD

The present invention relates to a single-face corrugated cardboard sheet-adhesive application device that applies adhesive liquid to apex portions of corrugated portions of a single-face corrugated cardboard sheet formed by gluing a liner to a corrugating medium, a method of applying an adhesive to a single-face corrugated cardboard sheet, and a corrugated cardboard sheet manufacturing apparatus that manufactures a double-face corrugated cardboard sheet by gluing liners to both sides of a corrugating medium.

BACKGROUND ART

A corrugating machine as a corrugated cardboard sheet manufacturing apparatus includes a single facer that forms a single-face corrugated cardboard sheet and a double facer that forms a double-face corrugated cardboard sheet by gluing bottom liner board paper to a single-face corrugated cardboard sheet. The single facer corrugates a corrugating medium that is fed from a mill roll stand, and forms a single-face corrugated cardboard sheet by gluing a top liner board, which is fed from another mill roll stand, to the corrugating medium. The single-face corrugated cardboard sheet, which is formed by the single facer, is sent to a bridge provided on the downstream side, and is sent to a double facer, which is provided on the downstream side, according to the speed thereof while being stored in the double facer. The double facer forms a double-face corrugated cardboard sheet by gluing a bottom liner board, which is sent from a separate mill roll stand, to the single-face corrugated cardboard sheet sent from the bridge. After predetermined slits or ruled lines are formed on the double-face corrugated cardboard sheet, which has passed through the double facer, in a conveying direction by a slitter scorer, the double-face corrugated cardboard sheet forms corrugated cardboard sheets by being cut in the width direction with a cutoff. The corrugated cardboard sheets are stacked on a stacker, and are sequentially discharged.

A bottom liner board is glued to the single-face corrugated cardboard sheet, which is formed by the single facer, by the double facer, so that the double-face corrugated cardboard sheet is formed. Accordingly, the corrugating machine is provided with an adhesive application device that applies adhesive liquid to apex portions of corrugated portions of the single-face corrugating medium (the single-face corrugated cardboard sheet). The adhesive application device applies adhesive liquid, which is stored in an adhesive liquid tank, to an adhesive application roller, and can transfer the adhesive liquid, which is applied to the adhesive application roller, to the apex portions of corrugated portions of the single-face corrugated cardboard sheet after adjusting the thickness of the adhesive liquid, which is applied to the adhesive application roller, to a set thickness by a doctor roller.

In this case, the width of the adhesive liquid, which is applied to the single-face corrugated cardboard sheet by the adhesive application device, needs to be adjusted according to the width of the bottom liner board that is to be glued to the single-face corrugated cardboard sheet. When the width of the adhesive liquid applied to the single-face corrugated cardboard sheet is not a width according to the width of the bottom liner board, the adhesive liquid is extruded from end portions of the bottom liner board. Accordingly, when the single-face corrugated cardboard sheet and the bottom liner board are sent to the double facer and travel on a hot plate, the adhesive liquid is applied to the hot plate and is solidified. For this reason, there is a concern that a single-face corrugated cardboard sheet and a bottom liner board to be subsequently conveyed may be damaged.

For example, there are means disclosed in the following PTLs as means for solving the problem. A liquid transfer device disclosed in PTL 1 includes a doctor roller that scrapes off surplus liquid applied to an applicator roller, a pair of damming plates that are spaced apart from each other in the axial direction of the applicator roller, and regulating parts that are provided on the damming plates and commonly come into contact with the peripheral surfaces of both the rollers facing each other. Further, an adhesive application method and an adhesive application device of a corrugated cardboard manufacturing apparatus disclosed in PTL 2 include dam plates that are provided on the upstream side of a doctor roller and adjust the thickness of adhesive liquid of a region inside an end of a single-face corrugated cardboard sheet, and elastic scrapers that are provided on the downstream side of the dam plates and remove adhesive liquid in a region inside an end of the single-face corrugated cardboard sheet.

CITATION LIST

Patent Literature

[PTL 1] Japanese Patent No. 2813719

[PTL 2] Japanese Unexamined Patent Application Publication No. 2011-212919

SUMMARY OF INVENTION

Technical Problem

In the above-mentioned liquid transfer device of PTL 1, the regulating parts are provided at end portions of the applicator roller in the axial direction. However, since the applicator roller is rotated at a high speed and scrapes off a large amount of adhesive liquid, it is difficult to prevent the extrusion of adhesive liquid by only the regulating parts. Further, the elastic scrapers and the dam plates are provided in the adhesive application method and the adhesive application device of the corrugated cardboard manufacturing apparatus disclosed in PTL 2, but there is a concern that the adhesive liquid may wrap around the dam plates and be extruded to the outside due to a viscous force thereof.

The invention has been made to solve the above-mentioned problems, and an object of the invention is to provide a web adhesive application device, a method of applying an adhesive to a web, and a corrugated cardboard sheet manufacturing apparatus that can prevent the extrusion of adhesive liquid from ends of a web.

Solution to Problem

In order to achieve the object, the invention provides a web adhesive application device including: an adhesive liquid tank that stores adhesive liquid; an adhesive application roller that allows the adhesive liquid of the adhesive liquid tank to be applied to a surface thereof and transfers the adhesive liquid to an adhesive application region of a web; a doctor roller that adjusts a thickness of the adhesive liquid applied to the adhesive application roller to a preset thickness; a scraping member that scrapes off the adhesive liquid, which is applied outside the adhesive application region, by coming into pressure contact with a surface of the adhesive application roller on an upstream side of a nip portion between the adhesive application roller and the doctor roller in a rotational direction; and a damming member that dams the adhesive liquid, which is extruded from the adhesive application region, by coming into contact with the surface of the adhesive application roller on the upstream side of the nip portion between the adhesive application roller and the doctor roller in the rotational direction and on a downstream side of a contact position of the scraping member in the rotational direction.

Accordingly, when the adhesive liquid of the adhesive liquid tank is applied to the surface of the adhesive application roller through the rotation of the adhesive application roller, first, the scraping member scrapes off the adhesive liquid, which is applied outside the adhesive application region, by coming into pressure contact with the surface of the adhesive application roller, the damming member then dams the adhesive liquid, which is extruded from the adhesive application region, by coming into contact with the surface of the adhesive application roller, and the doctor roller transfers the adhesive liquid, which is applied to the surface of the adhesive application roller, to the web after adjusting the thickness of the adhesive liquid, which is applied to the adhesive application region of the adhesive application roller, to a set thickness. That is, after the scraping member scrapes off the adhesive liquid, which is applied outside the adhesive application region, the damming member dams the adhesive liquid that is extruded from the adhesive application region. Accordingly, the extrusion of the adhesive liquid of the adhesive application region toward the end portions of the web in the width direction can be prevented.

In the web adhesive application device of the invention, the damming member is provided with a first curved contact surface that has a predetermined width in an axial direction of the adhesive application roller, has a predetermined length in a circumferential direction of the adhesive application roller, and comes into contact with the surface of the adhesive application roller; and the first curved contact surface extends to a nip portion between the adhesive application roller and the doctor roller.

Accordingly, the first curved contact surface of the damming member extends along the surface of the adhesive application roller to the nip portion between the adhesive application roller and the doctor roller. Therefore, since it is possible to dam the adhesive liquid to the nip portion between the adhesive application roller and the doctor roller by the first curved contact surface, it is possible to prevent the adhesive liquid from being extruded from the adhesive application region when the thickness of the adhesive liquid is adjusted to a set thickness by the doctor roller.

In the web adhesive application device of the invention, the damming member is provided with a second curved contact surface that comes into contact with a surface of the doctor roller, and the second curved contact surface extends to the nip portion between the adhesive application roller and the doctor roller.

Accordingly, the second curved contact surface of the damming member extends along the surface of the adhesive application roller to the nip portion between the adhesive application roller and the doctor roller. Therefore, the first curved contact surface dams the adhesive liquid to the nip portion between the adhesive application roller and the doctor roller, and the second curved contact surface can prevent the adhesive liquid from being extruded from the adhesive application roller to the doctor roller when the doctor roller adjusts the thickness of the adhesive liquid to a set thickness.

In the web adhesive application device of the invention, the scraping member is elastically deformable, and a deformation region is formed between the scraping member and the damming member.

Accordingly, when the scraping member scrapes off the adhesive liquid applied outside the adhesive application region by coming into pressure contact with the surface of the adhesive application roller, the scraping member is elastically deformed. However, since the deformation region is formed at the damming member, the scraping member enters the deformation region and can appropriately scrape off the adhesive liquid, which is applied to the surface of the adhesive application roller, without coming into contact with the damming member.

In the web adhesive application device of the invention, the damming member is supported so as to be pressed against the surface of the adhesive application roller.

Accordingly, since the damming member can come into close contact with the surface of the adhesive application roller without a clearance, the damming member can prevent the adhesive liquid from being extruded from the adhesive application region. Further, even when the contact surface of the damming member coming into contact with the adhesive application roller is worn out, the damming member can always come into close contact with the surface of the adhesive application roller. Accordingly, the damming member can prevent the adhesive liquid from being extruded from the adhesive application region for a long period of time.

The web adhesive application device of the invention further includes a plurality of biasing members that press the damming member against the surface of the adhesive application roller.

Accordingly, since the damming member is pressed against the surface of the adhesive application roller by the plurality of biasing members, the damming member can stably come into close contact with the surface of the adhesive application roller. Therefore, the damming member can prevent the adhesive liquid from being extruded from the adhesive application region.

In the web adhesive application device of the invention, the damming member is supported so as to be slidable in a direction which is orthogonal to axial directions of the adhesive application roller and the doctor roller and in which the damming member is adjacent to the adhesive application roller and the doctor roller.

Accordingly, since the damming member is slidably supported, the damming member can appropriately come into contact with the surface of the adhesive application roller regardless of a state in which the damming member or the adhesive application roller is mounted.

In the web adhesive application device of the invention, the damming member has a predetermined width in the axial direction of the adhesive application roller, and one end portion of the damming member in a width direction corresponds to an end portion of the adhesive application region in the width direction; and the scraping member has a predetermined width in the axial direction of the adhesive application roller, and one end portion of the scraping member in the width direction corresponds to an end portion of the adhesive application region in the width direction or extends within the adhesive application region by a predetermined length.

Accordingly, the scraping member can appropriately scrape off the adhesive liquid that is applied outside the adhesive application region and the damming member can appropriately prevent the adhesive liquid from being extruded from the adhesive application region. Further, when one end portion of the scraping member extends within the adhesive application region, the scraping member scrapes off not only the adhesive liquid outside the adhesive application region but also the adhesive liquid of a part of the inside of the adhesive application region. Accordingly, even though the scraping member and the damming member are spaced apart from each other by a predetermined distance, the damming member can appropriately prevent the adhesive liquid from being extruded from the adhesive application region.

In the web adhesive application device of the invention, a metal layer is provided on the surface of the adhesive application roller, and a resin layer is formed on the contact surface of the damming member.

Accordingly, since the damming member of which the surface is made of a resin comes into contact with the adhesive application roller of which the surface is made of metal, damage to the surface of the adhesive application roller is prevented. As a result, it is possible to appropriately prevent the adhesive liquid from being extruded from the adhesive application region for a long period of time.

In the web adhesive application device of the invention, the scraping member and the damming member are supported by the same support member.

Accordingly, since it is possible to improve the mountability of the scraping member and the damming member and to adjust the positions of the scraping member and the damming member by only adjusting the position of the support arm, it is possible to improve workability.

In the web adhesive application device of the invention, the support member is positioned relative to a device frame by three support faces along directions that cross each other.

Accordingly, since the support member can be positioned on the device frame by three support faces, the scraping member and the damming member can be easily positioned through the support member. Accordingly, it is possible to improve positioning accuracy and mounting workability.

In the web adhesive application device of the invention, the device frame is provided with a moving member that is movable in the axial direction of the adhesive application roller, and the support member is supported by the moving member.

Accordingly, since the support member is moved by the moving member, the positions of the scraping member and the damming member can be easily changed according to the width of the web. Therefore, versatility can be improved.

In the web adhesive application device of the invention, the web is a single-face corrugated cardboard sheet in which a second liner is glued to a corrugating medium, and the damming member is disposed inside a position of an end portion of a first liner, which is glued to the corrugating medium of the single-face corrugated cardboard sheet, in the width direction by the moving member.

Accordingly, it is possible to prevent the adhesive liquid of the adhesive application region from being extruded to the end portion of the first liner in the width direction regardless of the change of the width of the first liner.

In the web adhesive application device of the invention, the position of the end portion of the first liner in the width direction is output from a production management device.

Accordingly, it is possible to appropriately position the damming member.

In the web adhesive application device of the invention, the position of the end portion of the first liner in the width direction is output from a sensor that detects the end portion of the first liner in the width direction.

Accordingly, it is possible to appropriately position the damming member.

In the web adhesive application device of the invention, the adhesive liquid tank includes a bottom plate of which one end portion is disposed with a predetermined clearance interposed between the bottom plate and the surface of the adhesive application roller, a pair of side plates which are connected to both side portions of the bottom plate and of which each of one end portions is disposed so as to be pressed against the surface of the adhesive application roller, and a regulating plate that is connected to the other end portion of the bottom plate and allows the stored adhesive liquid to overflow; and a storage pan is disposed below the adhesive liquid tank.

Accordingly, since the adhesive liquid tank includes the bottom plate and the pair of side plates and the regulating plate, it is possible to simplify the structure of the adhesive liquid tank and to reduce the amount of the adhesive liquid stored in the adhesive liquid tank. Therefore, it is possible to reduce operating costs. Further, since a predetermined clearance is formed between the bottom plate and the adhesive application roller, it is possible to prevent damage to the surface of the adhesive application roller. In this case, the adhesive liquid of the adhesive liquid tank flows downward from the clearance between the adhesive application roller and the bottom plate during the stop of the adhesive application roller, but the adhesive liquid having flowed downward is stored in the storage pan. Accordingly, adhesive liquid can be easily collected.

The web adhesive application device of the invention further includes a circulation path allowing adhesive liquid, which falls down from a predetermined clearance between the adhesive application roller and the bottom plate, and adhesive liquid, which overflows the regulating plate, to be filtered and to return to the adhesive liquid tank.

Accordingly, since adhesive liquid, which falls down from a predetermined clearance between the adhesive application roller and the bottom plate, and adhesive liquid, which overflows the regulating plate, are made to return to the adhesive liquid tank by the circulation path after being filtered, the adhesive liquid can be easily collected and foreign substances mixed with the adhesive liquid can be easily removed. Therefore, stable work for applying an adhesive can be performed.

Further, the invention provides a method of applying an adhesive to a web including: applying adhesive liquid to a surface of an adhesive application roller through a rotation of the adhesive application roller; scraping off adhesive liquid, which is applied outside a web adhesive application region, by making a scraping member come into pressure contact with the surface of the adhesive application roller; damming adhesive liquid, which is extruded from the adhesive application region, by making a damming member come into contact with the surface of the adhesive application roller; adjusting a thickness of the adhesive liquid, which is applied to the web adhesive application region of the adhesive application roller, to a preset thickness by a doctor roller; and transferring the adhesive liquid, which is applied to the surface of the adhesive application roller, to the web.

Accordingly, after the scraping member scrapes off the adhesive liquid, which is applied outside the adhesive application region, the damming member dams the adhesive liquid that is extruded from the adhesive application region. Therefore, the extrusion of the adhesive liquid of the adhesive application region toward the end portions of the web in the width direction can be prevented.

Furthermore, the invention provides a corrugated cardboard sheet manufacturing apparatus including: a single facer that manufactures a single-face corrugated cardboard sheet by gluing a second liner to the corrugating medium; a glue machine that applies adhesive liquid to apex portions of corrugated portions of the single-face corrugated cardboard sheet; and a double facer that manufactures a double-face corrugated cardboard sheet by gluing a first liner to a corrugating medium side of the single-face corrugated cardboard sheet. The glue machine is provided with the web adhesive application device.

Accordingly, the single facer manufactures the single-face corrugated cardboard sheet by gluing the second liner to the corrugating medium, the glue machine applies adhesive liquid to the apex portions of the corrugated portions of the single-face corrugated cardboard sheet, and the double facer manufactures the double-face corrugated cardboard sheet by gluing the first liner to the corrugating medium side of the single-face corrugated cardboard sheet that is manufactured by the single facer. At this time, in the glue machine, when the adhesive liquid of the adhesive liquid tank is applied to the surface of the adhesive application roller through the rotation of the adhesive application roller, first, the scraping member scrapes off the adhesive liquid, which is applied outside the adhesive application region, by coming into pressure contact with the surface of the adhesive application roller, the damming member then dams the adhesive liquid, which is extruded from the adhesive application region, by coming into contact with the surface of the adhesive application roller, and the doctor roller transfers the adhesive liquid, which is applied to the surface of the adhesive application roller, to the web after adjusting the thickness of the adhesive liquid, which is applied to the adhesive application region of the adhesive application roller, to a set thickness. That is, after the scraping member scrapes off the adhesive liquid, which is applied outside the adhesive application region, the damming member dams the adhesive liquid that is extruded from the adhesive application region. Accordingly, the extrusion of the adhesive liquid of the adhesive application region toward the end portions of the web in the width direction can be prevented.

Advantageous Effects of Invention

According to the web adhesive application device, the method of applying an adhesive to a web, and the corrugated cardboard sheet manufacturing apparatus of the invention, the web adhesive application device includes: the scraping member that scrapes off the adhesive liquid, which is applied outside the adhesive application region, by coming into pressure contact with the surface of the adhesive application roller on the upstream side of the nip portion between the adhesive application roller and the doctor roller in the rotational direction; and the damming member that dams the adhesive liquid, which is extruded from the adhesive application region, by coming into contact with the surface of the adhesive application roller on the upstream side of the nip portion between the adhesive application roller and the doctor roller in the rotational direction and on the downstream side of the contact position of the scraping member in the rotational direction. Accordingly, the extrusion of the adhesive liquid of the adhesive application region toward the end portions of the web in the width direction can be prevented.

DESCRIPTION OF EMBODIMENTS

Preferred embodiments of a web adhesive application device, a method of applying an adhesive to a web, and a corrugated cardboard sheet manufacturing apparatus of the invention will be described in detail below with reference to the accompanying drawings. Meanwhile, the invention is not limited by the embodiments, and includes combinations of the respective embodiments when there are plural embodiments.

Embodiment

Figure 1:
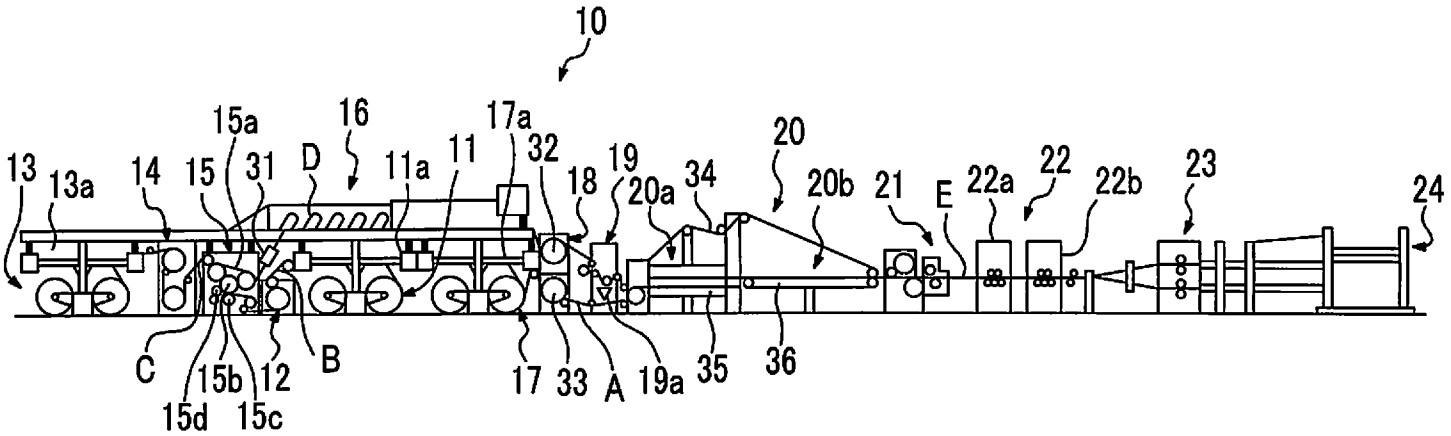
FIG. 1 is a schematic view showing a corrugating machine as a corrugated cardboard sheet manufacturing apparatus according to an embodiment of the invention.

FIG. 1 is a schematic view showing a corrugating machine as a corrugated cardboard sheet manufacturing apparatus according to an embodiment of the invention.

In this embodiment, as shown in FIG. 1, a corrugating machine 10 as a corrugated cardboard sheet manufacturing apparatus manufactures a single-face corrugated cardboard sheet D by gluing, for example, a top liner board C serving as a second liner to the corrugating medium B and manufactures a double-face corrugated cardboard sheet E by gluing, for example, a bottom liner board A serving as a first liner to the corrugating medium B of the manufactured single-face corrugated cardboard sheet D.

The corrugating machine 10 includes a mill roll stand 11 for the corrugating medium B, a preheater (preheating device) 12, a mill roll stand 13 for the top liner board C, a preheater (preheating device) 14, a single facer 15, a bridge 16, a mill roll stand 17 for the bottom liner board A, a preheater (preheating device) 18, a glue machine 19, a double facer 20, rotary shears 21, a slitter scorer 22, a cutoff 23, and a stacker 24.

Rolls of paper are mounted on both sides of the mill roll stand 11, and the roll of paper is formed by winding the corrugating medium, on which the corrugating medium B is formed, in the form of a roll. A splicer (splicing device) 11*a*, which performs splicing, is provided above the rolls of paper. When paper is fed from one roll of paper, the other roll of paper is mounted for the preparation of splicing. When a small amount of base paper of one roll of paper remains, the base paper of one roll of paper is spliced to base paper of the other roll of paper by the splicer 11*a*. Further, while the base paper is fed from the other roll of paper, one roll of paper is mounted for the preparation of splicing. Base paper is sequentially spliced in this way and is continuously delivered to the downstream side from the mill roll stand 11.

Meanwhile, rolls of paper, which are formed by winding the top liner board C in the form of a roll, are mounted on both sides of the mill roll stand 13, and a splicer 13*a* performing splicing is provided above the rolls of paper. When paper is fed from one roll of paper, the other roll of paper is mounted for the preparation of splicing. When a small amount of base paper of one roll of paper remains, the base paper of one roll of paper is spliced to base paper of the other roll of paper by the splicer 13*a*. Further, while the base paper is fed from the other roll of paper, one roll of paper is mounted for the preparation of splicing. Base paper is sequentially spliced in this way and is continuously delivered to the downstream side from the mill roll stand 13.

The preheaters 12 and 14 preheat the corrugating medium B and the top liner board C, respectively. Each of the preheaters 12 and 14 includes a heating roller into which steam is supplied, and the base paper (the corrugating medium B and the top liner board C) continuously delivered from the mill roll stands 11 and 13 are conveyed while being wound on the heating rollers. Accordingly, the temperature of the base paper rises to a predetermined temperature.

The single facer 15 includes a pressing belt 15*a*, an upper corrugating roller 15*b*, and a lower corrugating roller 15*c*. The top liner board C, which is heated by the preheater 14, is transferred to a nip portion between the pressing belt 15*a* and the upper corrugating roller 15*b*. Meanwhile, the corrugating medium B, which is heated by the preheater 12, is transferred to the nip portion between the pressing belt 15*a* and the upper corrugating roller 15*b* after being corrugated by an engagement portion between the upper and lower corrugating rollers 15*b* and 15*c*.

An adhesive application device 15*d* is disposed near the upper corrugating roller 15*b*. The adhesive application device 15*d* includes an adhesive application roller that applies an adhesive to the corrugating medium B. An adhesive is applied to an apex portion of each corrugated portion of the corrugating medium B, which is corrugated by the engagement portion between the upper and lower corrugating rollers 15*b* and 15*c*, by the adhesive application device 15*d* (adhesive application roller); and the corrugating medium B is glued to the top liner board C at the nip portion between the pressing belt 15*a* and the upper corrugating roller 15*b*. As a result, the single-face corrugated cardboard sheet D is formed.

A take-up conveyor 31 is provided obliquely above the single facer 15 on the downstream side in a conveying direction. The take-up conveyor 31 includes a pair of endless belts, and has a function to hold the single-face corrugated cardboard sheet D, which is formed by the single facer 15, and to convey the single-face corrugated cardboard sheet D to the bridge 16. The bridge 16 functions as a staying unit that makes the single-face corrugated cardboard sheet D primarily stay to absorb a speed difference between the single facer 15 and the double facer 20.

Rolls of paper, which are formed by winding the bottom liner board A in the form of a roll, are mounted on both sides of the mill roll stand 17, and a splicer 17*a* performing splicing is provided above the rolls of paper. When paper is fed from one roll of paper, the other roll of paper is mounted for the preparation of splicing. When a small amount of base paper of one roll of paper remains, the base paper of one roll of paper is spliced to base paper of the other roll of paper by the splicer 17*a*. Further, while the base paper is fed from the other roll of paper, one roll of paper is mounted for the preparation of splicing. Base paper is sequentially spliced in this way and is continuously delivered to the downstream side from the mill roll stand 17.

The preheater 18 includes a heating roller 32 for the single-face corrugated cardboard sheet D (hereinafter, referred to as a single-face corrugated sheet heating roller) and a heating roller 33 for the bottom liner board A (hereinafter, referred to as a bottom liner board heating roller). The single-face corrugated sheet heating roller 32 includes a wound-amount adjuster. Steam is supplied into the single-face corrugated sheet heating roller 32, so that the single-face corrugated sheet heating roller 32 is heated to a predetermined temperature. Accordingly, when the top liner board C of the single-face corrugated cardboard sheet D is wound on the peripheral surface of the single-face corrugated sheet heating roller 32, the single-face corrugated cardboard sheet D can be preheated. Likewise, the bottom liner board heating roller 33 includes a wound-amount adjuster. Steam is supplied into the bottom liner board heating roller 33, so that the bottom liner board heating roller 33 is heated to a predetermined temperature. Accordingly, when the bottom liner board A is wound on the peripheral surface of the bottom liner board heating roller 33, the bottom liner board A can be preheated.

The glue machine 19 includes an adhesive application device and a pressing device. When the single-face corrugated cardboard sheet D heated by the single-face corrugated sheet heating roller 32 is guided in the glue machine 19 and passes between a rider roller and the adhesive application roller, an adhesive is applied to an apex portion of each corrugated portion of the corrugating medium B.

The single-face corrugated cardboard sheet D to which the adhesive has been applied by the glue machine 19 is transferred to the double facer 20 of the next step. Further, the bottom liner board A heated by the bottom liner board heating roller 33 is also transferred to the double facer 20 through the glue machine 19.

The double facer 20 is divided into an upstream heating section 20*a* and a downstream cooling section 20*b* along a traveling line of the single-face corrugated cardboard sheet D and the bottom liner board A. The single-face corrugated cardboard sheet D to which an adhesive has been applied by the glue machine 19 is conveyed into a gap between a pressing belt 34 and a hot plate 35 in the heating section 20*a*, and the bottom liner board A is conveyed into a gap between the pressing belt 34 and the hot plate 35 so as to overlap the corrugating medium B of the single-face corrugated cardboard sheet D.

Furthermore, after the single-face corrugated cardboard sheet D and the bottom liner board A are conveyed into the gap between the pressing belt 34 and the hot plate 35, the single-face corrugated cardboard sheet D and the bottom liner board A are integrated with each other and transferred to the cooling section 20*b* while overlapping each other in a vertical direction. When the single-face corrugated cardboard sheet D and the bottom liner board A are heated while being pressed during the transfer thereof, the single-face corrugated cardboard sheet D and the bottom liner board A are glued to each other and form a double-face corrugated cardboard sheet E. When the double-face corrugated cardboard sheet E is conveyed while being held between the pressing belt 34 and a conveying belt 36, the double-face corrugated cardboard sheet E is naturally cooled in the cooling section 20*b*.

The double-face corrugated cardboard sheet E manufactured by the double facer 20 is transferred to the rotary shears 21. The rotary shears 21 cut the entire double-face corrugated cardboard sheet E or partially cut the double-face corrugated cardboard sheet E in a width direction. The slitter scorer 22 cuts out the wide double-face corrugated cardboard sheet E so that the double-face corrugated cardboard sheet E has a predetermined width in the conveying direction, and forms ruled lines extending in the conveying direction. The slitter scorer 22 includes a first slitter scorer unit 22*a* and a second slitter scorer unit 22*b* that are arranged along the conveying direction of the double-face corrugated cardboard sheet E and have substantially the same structure. Each of the first and second slitter scorer units 22*a* and 22*b* includes a plurality of sets of upper and lower ruled line rollers that are disposed so as to face each other with the double-face corrugated cardboard sheet E interposed therebetween and are arranged in the width direction, and includes a plurality of sets of slitter knives that are disposed below the double-face corrugated cardboard sheet E and are arranged in the width direction.

The cutoff 23 cuts the double-face corrugated cardboard sheet E, which is cut out in the conveying direction by the slitter scorer 22, in the width direction to form the double-face corrugated cardboard sheet E in the form of a sheet. The cutoff 23 receives two double-face corrugated cardboard sheets E, which are cut into a predetermined width in the conveying direction by the slitter scorer 22, in upper and lower (two) stages and processes the two double-face corrugated cardboard sheets E. Both the slitter scorer 22 and the cutoff 23 have substantially the same structure. The stacker 24 stacks the double-face corrugated cardboard sheets E, which are cut by the cutoff 23, and discharges the stacked double-face corrugated cardboard sheets to the outside of the machine as a product.

A web adhesive application device of this embodiment will be described here. The web adhesive application device of this embodiment is provided in the above-mentioned glue machine 19, and supplies adhesive liquid to apex portions of corrugated portions of the corrugating medium B of the single-face corrugated cardboard sheet D as a web.

Figure 2:
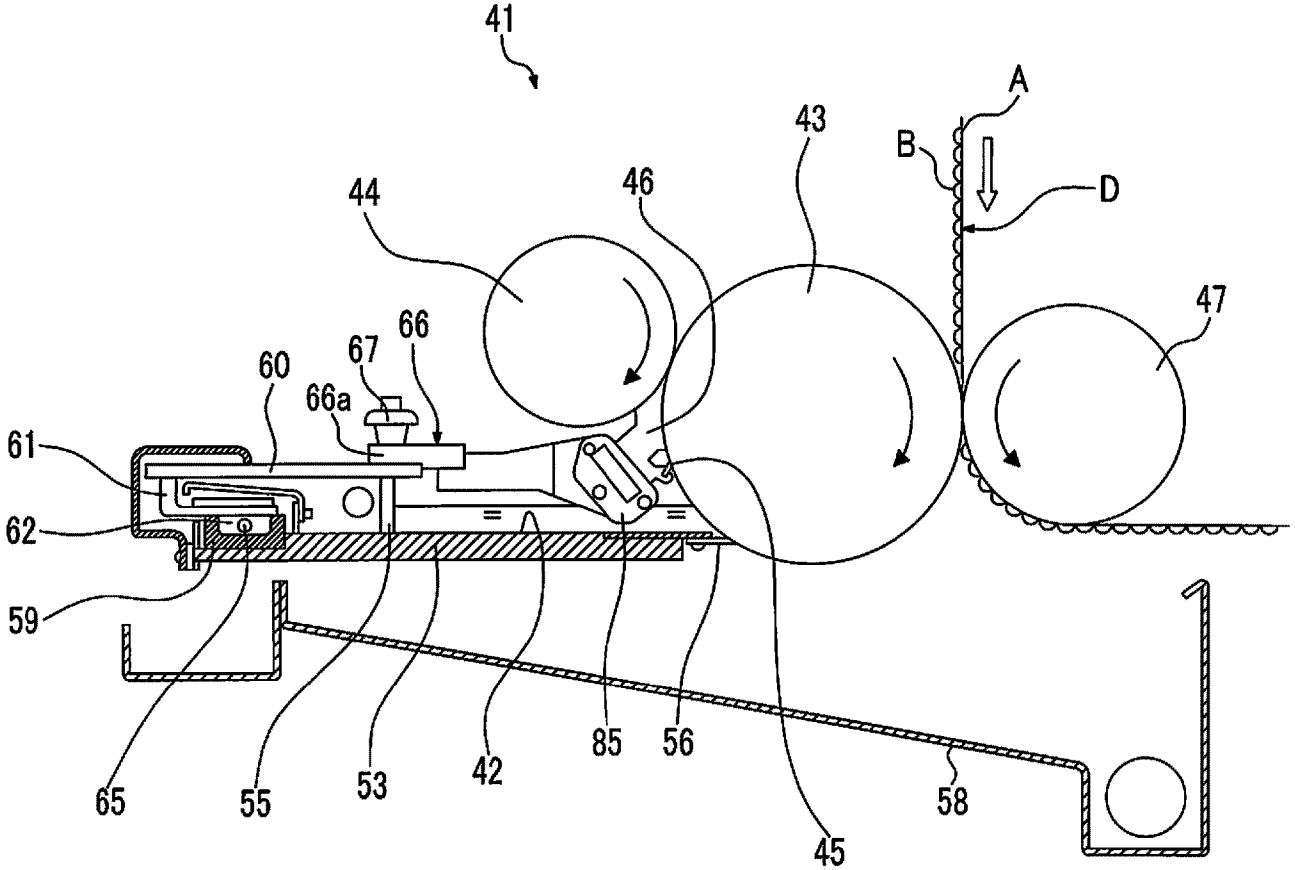
FIG. 2 is a schematic view showing a web adhesive application device of this embodiment.
Figure 3:
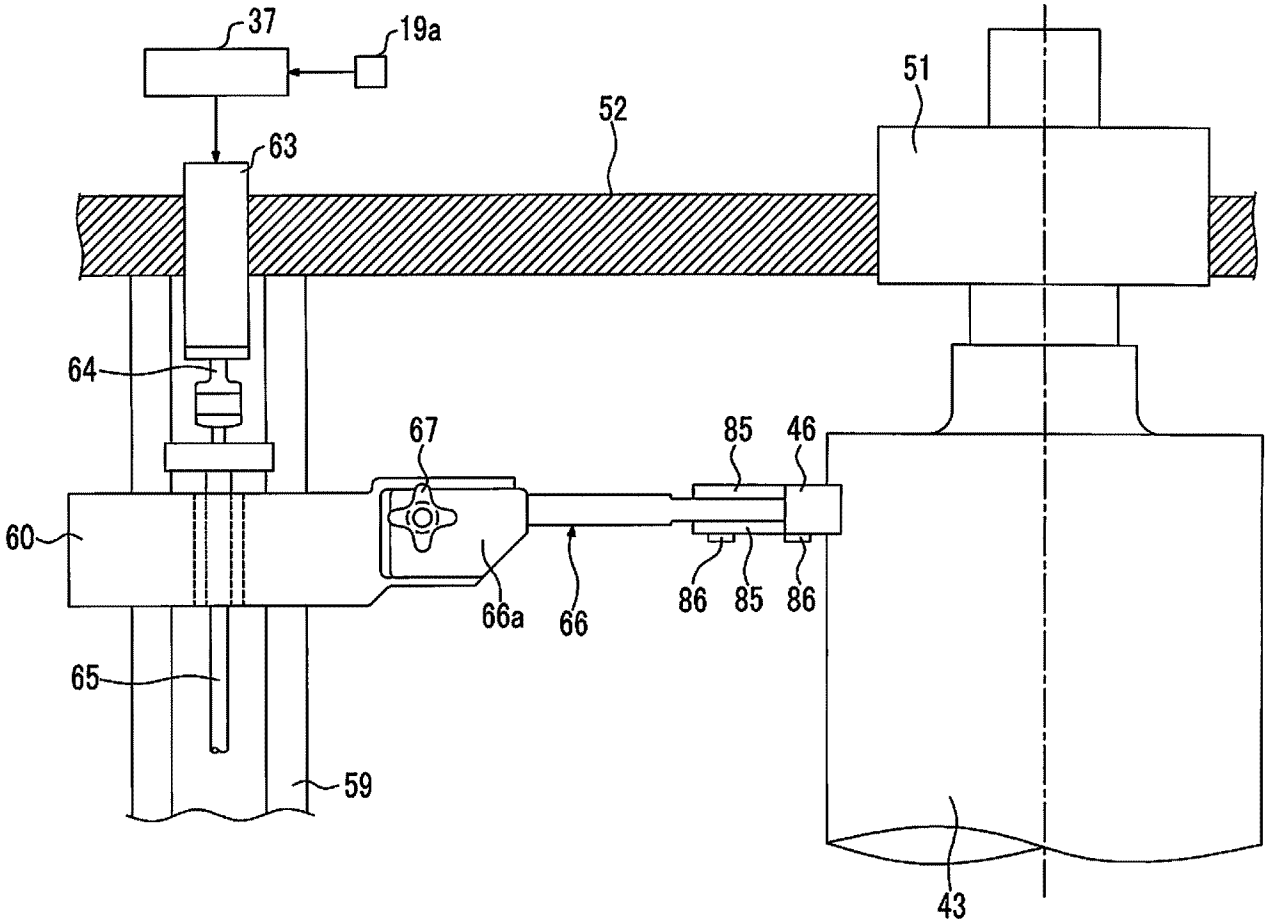
FIG. 3 is a plan view showing main parts of a glue machine.
Figure 4:
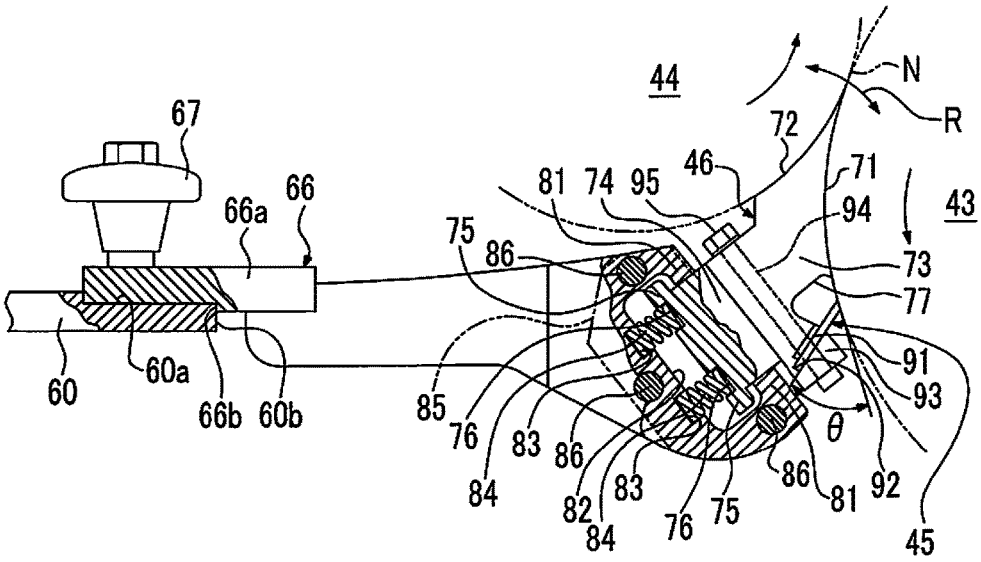
FIG. 4 is a front view showing a scraping member and a damming member.
Figure 5:
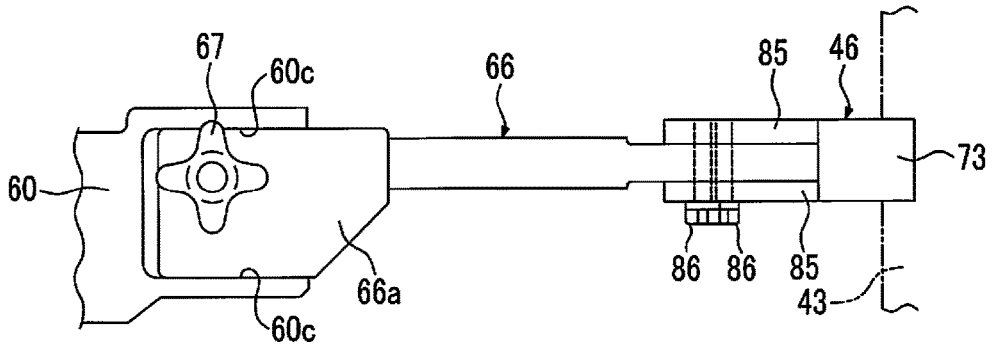
FIG. 5 is a plan view showing the scraping member and the damming member.
Figure 6:
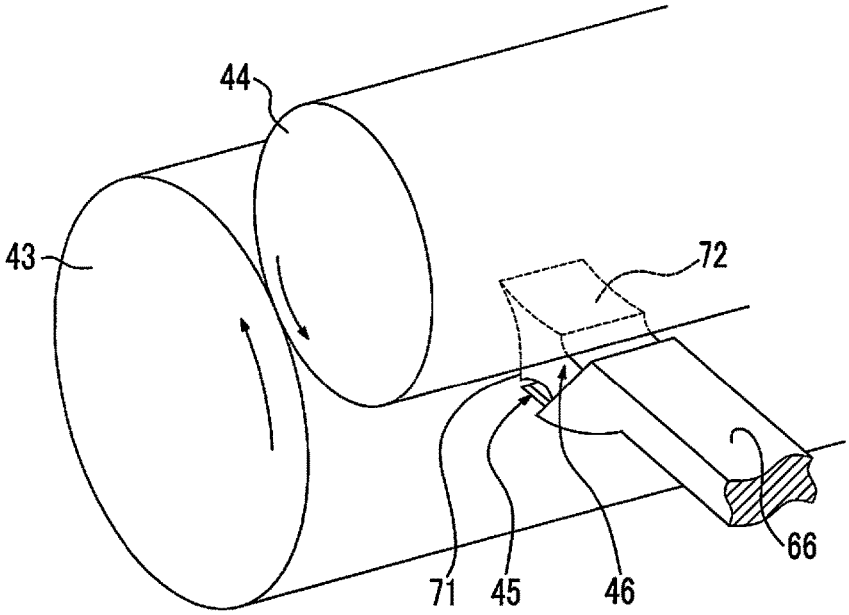
FIG. 6 is a schematic view showing a state in which the scraping member and the damming member are mounted.
Figure 7:
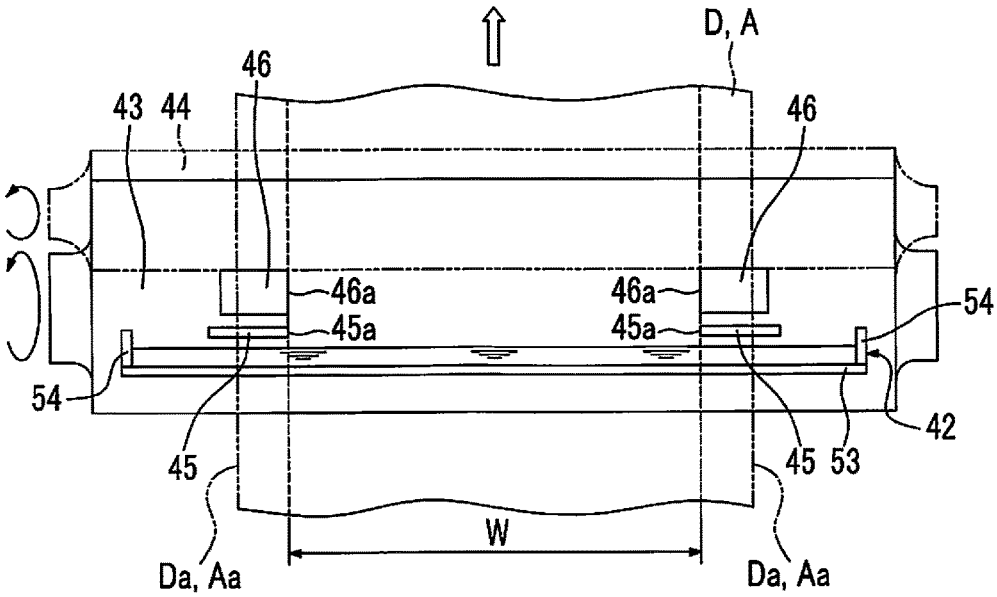
FIG. 7 is a schematic view showing the disposition of the scraping members and the damming members on the adhesive application roller.
Figure 8A:
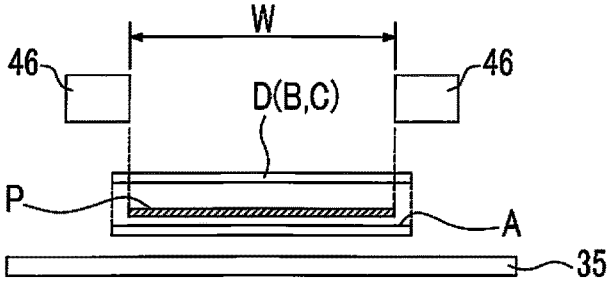
FIG. 8A is a schematic view showing an adhesive application region W of a single-face corrugated cardboard sheet D.
Figure 8B:
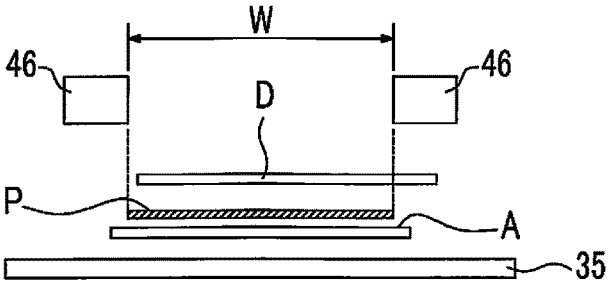
FIG. 8B is a schematic view showing the adhesive application region W of the single-face corrugated cardboard sheet D that is shifted in a width direction.
Figure 8C:
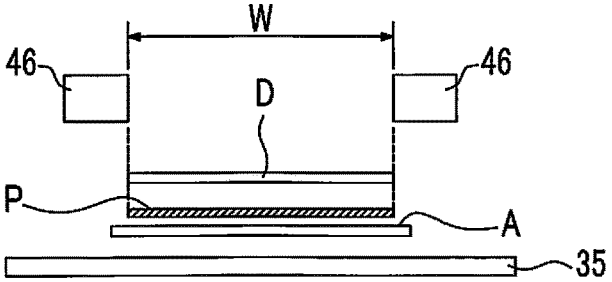
FIG. 8C is a schematic view showing an adhesive application region W of a narrow single-face corrugated cardboard sheet D.
Figure 8D:
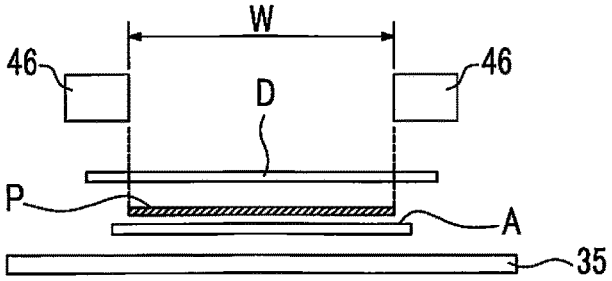
FIG. 8D is a schematic view showing an adhesive application region W of a wide single-face corrugated cardboard sheet D.
Figure 9:
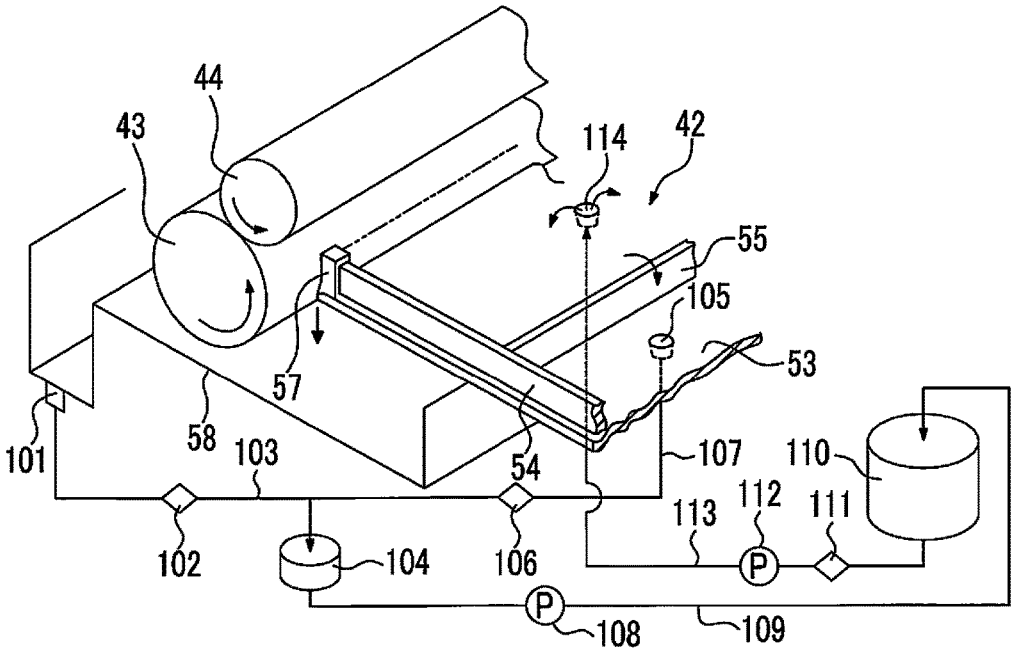
FIG. 9 is a schematic view showing a circulation path of adhesive liquid in the glue machine.

FIG. 2 is a schematic view showing the web adhesive application device of this embodiment, FIG. 3 is a plan view showing main parts of the glue machine, FIG. 4 is a front view showing a scraping member and a damming member, FIG. 5 is a plan view showing the scraping member and the damming member, FIG. 6 is a schematic view showing a state in which the scraping member and the damming member are mounted, FIG. 7 is a schematic view showing the disposition of the scraping members and the damming members on the adhesive application roller, FIG. 8A is a schematic view showing an adhesive application region W of the single-face corrugated cardboard sheet D, FIG. 8B is a schematic view showing the adhesive application region W of the single-face corrugated cardboard sheet D that is shifted in the width direction, FIG. 8C is a schematic view showing an adhesive application region W of a narrow single-face corrugated cardboard sheet D, FIG. 8D is a schematic view showing an adhesive application region W of a wide single-face corrugated cardboard sheet D, and FIG. 9 is a schematic view showing a circulation path of adhesive liquid in the glue machine.

In this embodiment, as shown in FIGS. 2 and 3, the adhesive application device 41 includes an adhesive liquid tank 42, an adhesive application roller 43, a doctor roller 44, scraping members 45, damming members 46, and a rider roller 47.

The adhesive application roller 43 is a roller having a columnar shape, and each end portion of the adhesive application roller 43 in an axial direction is rotatably supported on a device frame 52 by a bearing 51. The doctor roller 44 is a roller having a columnar shape, each end portion of the doctor roller 44 in an axial direction is rotatably supported on the device frame 52 by a bearing (not shown), and a nip portion having a predetermined clearance is secured between the adhesive application roller 43 and the doctor roller 44. Each end portion of the rider roller 47 in an axial direction is rotatably supported on the device frame 52 by a bearing (not shown), and the single-face corrugated cardboard sheet D is conveyed between the adhesive application roller 43 and the rider roller 47. Meanwhile, the doctor roller 44 and the rider roller 47 are supported so as to be capable of approaching and being separated from the adhesive application roller 43, and the size of the nip portion can be adjusted between the adhesive application roller 43 and the doctor roller 44 and between the adhesive application roller 43 and the rider roller 47.

The adhesive application roller 43 can be rotationally driven in a clockwise direction in FIG. 2 by a drive unit (not shown), the doctor roller 44 can be rotationally driven in a clockwise direction in FIG. 2, and the rider roller 47 is rotatable in the counterclockwise direction in FIG. 2. In this case, the adhesive application roller 43 is rotationally driven in synchronization with the conveying speed of the single-face corrugated cardboard sheet D. The single-face corrugated cardboard sheet D is wound on the rider roller 47 over a predetermined angle range, so that the rider roller 47 is rotated by the single-face corrugated cardboard sheet D.

Meanwhile, the adhesive application roller 43 is formed of a metal roller of which the surface has an uneven shape and is subjected to chrome plating so that adhesive liquid is easily applied to the adhesive application roller 43. Further, each of the doctor roller 44 and the rider roller 47 is formed of a metal roller of which the surface has a flat shape and is subjected to chrome plating. In this case, each of the rollers 43, 44, and 47 may be made of stainless steel.

An upper portion of the adhesive liquid tank 42 is open, the adhesive liquid tank 42 can store adhesive liquid, and a part of the adhesive application roller 43 comes into contact with the adhesive liquid tank 42 so that adhesive liquid can be applied to the surface of the adhesive application roller 43. As shown in FIGS. 7 and 9, the adhesive liquid tank 42 includes a bottom plate 53, a pair of side plates 54, and a regulating plate 55, and the adhesive application roller 43 is disposed at one end portion of the bottom plate 53.

The width of the bottom plate 53 is set to be smaller than the width of the adhesive application roller 43, and a seal plate 56 is fixed to one end portion of the bottom plate 53. The seal plate 56 is disposed so that a predetermined clearance is formed between the seal plate 56 and the surface of the adhesive application roller 43. Further, the side plates 54 are fixed to both side portions of the bottom plate 53, and a seal member 57 is mounted on one end portion of each side plate 54. The seal member 57 is supported so as to be pressed against the surface of the adhesive application roller 43 by a biasing member (spring) (not shown). For this reason, a width where adhesive liquid is applied to the adhesive application roller 43 is set by the bottom plate 53 and the side plates 54. The regulating plate 55 is fixed to the other end portions of the bottom plate 53 and the side plates 54, and is set to be lower than the bottom plate 53 and the side plates 54. Accordingly, when the amount of adhesive liquid is increased, the adhesive liquid overflows the regulating plate 55. As a result, the amount of adhesive liquid stored in the adhesive liquid tank 42 can be maintained constant.

Furthermore, a storage pan 58 is disposed below the adhesive liquid tank 42. The seal plate 56 of the bottom plate 53 of the adhesive liquid tank 42 is disposed so that a predetermined clearance is formed between the seal plate 56 and the surface of the adhesive application roller 43, and the seal members 57 of the side plate 54 are pressed against the surface of the adhesive application roller 43. Accordingly, when the adhesive application roller 43 is rotated, the leakage of the adhesive liquid of the adhesive liquid tank 42 from the predetermined clearance between the seal plate 56 and the adhesive application roller 43, which is caused by the rotational force of the adhesive application roller 43, does not occur. Meanwhile, when the adhesive application roller 43 stops, the adhesive liquid of the adhesive liquid tank 42 leaks from the predetermined clearance between the seal plate 56 and the adhesive application roller 43 and is stored in the storage pan 58.

Returning to FIGS. 2 and 3, the adhesive application roller 43 and the doctor roller 44 are disposed so that the rotation axes of the adhesive application roller 43 and the doctor roller 44 are parallel to each other, but the rotational directions of the adhesive application roller 43 and the doctor roller 44 are opposite to each other at the nip portion. Accordingly, a predetermined clearance is secured at the nip portion between the adhesive application roller 43 and the doctor roller 44. For this reason, the doctor roller 44 can adjust the thickness of the adhesive liquid to a predetermined thickness by scraping the adhesive liquid that is applied to the adhesive application roller 43. Further, the adhesive application roller 43 and the rider roller 47 are disposed so that the rotation axes of the adhesive application roller 43 and the rider roller 47 are parallel to each other, and the rotational directions of the adhesive application roller 43 and the rider roller 47 are the same as each other at the nip portion. It is possible to convey the single-face corrugated cardboard sheet D, which passes between the adhesive application roller 43 and the doctor roller 44, in a direction indicated by an arrow and to apply adhesive liquid to apex portions of corrugated portions of the single-face corrugated cardboard sheet D.

In this case, since the doctor roller 44 adjusts the thickness of the adhesive liquid to a set thickness by scraping the adhesive liquid that is applied to the adhesive application roller 43, the adhesive application roller 43 can apply the amount of adhesive liquid, which corresponds to the adjusted predetermined thickness, to the apex portions of the corrugated portions of the single-face corrugated cardboard sheet D.

A guide rail 59, which is parallel to the respective rollers 43, 44, and 47, is disposed at the doctor roller 44 of the adhesive application roller 43, and each longitudinal end portion of the guide rail 59 is fixed to the device frame 52. A moving plate (moving member) 60 is disposed above the guide rail 59 along a direction orthogonal to the guide rail 59, and a slide 62 is fixed to a base end portion of the moving plate 60 through a bracket 61. The slide 62 is supported so as to be movable along the guide rail 59. Furthermore, a drive motor 63 is fixed to the device frame 52, and a screw shaft 65 connected to a drive shaft 64 is threadedly engaged with the slide 62. Accordingly, when the drive motor 63 is driven, the screw shaft 65 is rotated by the drive shaft 64 and the moving plate 60 can be moved along the guide rail 59 by the slide 62 with which the drive shaft 64 is threadedly engaged.

A support arm (support member) 66 extends from the moving plate 60 toward the adhesive application roller 43, a base end portion of the support arm 66 is fixed to the moving plate 60 by a fastening bolt 67, and the scraping members 45 and the damming members 46 are mounted at the tip portion of the support arm 66. In this case, the support arm 66 can be positioned relative to the moving plate 60 by three support faces along the directions that cross each other. That is, as shown in FIGS. 4 and 5, the lower surface of a base end portion-side mounting portion **66*a* is placed on a placement surface 60*a* that is formed at the tip portion of the moving plate 60, so that the support arm 66 is positioned in a vertical direction. Further, a base end portion-side stepped portion 66*b* comes into contact with an end face 60*b* that is formed at the tip portion of the moving plate 60, so that the support arm 66 is positioned in the longitudinal direction (a direction where the support arm 66 approaches and is separated from the adhesive application roller 43). Furthermore, left and right side surfaces of the base end portion-side mounting portion 66*a* come into contact with vertical wall surfaces 60*c* formed at the tip portion of the moving plate 60, so that the support arm 66 is positioned in the width direction (an axial direction of the adhesive application roller 43**).

Further, returning to FIGS. 2 and 3, since the scraping member 45 and the damming member 46 are supported by the same support arm 66, the scraping member 45 and the damming member 46 can be easily positioned relative to the adhesive application roller 43 and can be integrally moved in the axial direction of the adhesive application roller 43. Accordingly, the positions of the scraping member 45 and the damming member 46 can be easily adjusted. That is, the positions of the scraping member 45 and the damming member 46 need to be adjusted according to the width of the bottom liner board A that is glued to the single-face corrugated cardboard sheet D, and the adjustment of the positions of the scraping member 45 and the damming member 46 can be easily performed.

As shown in FIGS. 4 to 7, the scraping member 45 scrapes off adhesive liquid, which is applied to the single-face corrugated cardboard sheet D outside an adhesive application region, by coming into pressure contact with the surface of the adhesive application roller 43 on the upstream side of the nip portion between the adhesive application roller 43 and the doctor roller 44 in the rotational direction. Furthermore, the damming member 46 dams the adhesive liquid, which is extruded from the adhesive application region of the single-face corrugated cardboard sheet D, by coming into contact with the surface of the doctor roller 44 on the upstream side of the nip portion between the adhesive application roller 43 and the doctor roller 44 in the rotational direction and on the downstream side of the contact position of the scraping member 45 in the rotational direction.

That is, when the single-face corrugated cardboard sheet D is conveyed relative to the adhesive application roller 43, the adhesive application region W of the single-face corrugated cardboard sheet D is adjusted according to the width of the bottom liner board A that is glued to the single-face corrugated cardboard sheet D by the double facer 20 provided on the downstream side. Specifically, the width of the adhesive application region W of the single-face corrugated cardboard sheet D is adjusted so as to be smaller than the width of the bottom liner board A. Here, the width of the single-face corrugated cardboard sheet D and the width of the bottom liner board A are set to be equal to each other. For this reason, the damming members 46 are disposed in regions positioned near the left and right ends of the single-face corrugated cardboard sheet D and the bottom liner board A that are being conveyed. Further, the scraping members 45 are also disposed in regions positioned near the left and right ends of the single-face corrugated cardboard sheet D and the bottom liner board A that are being conveyed.

In this embodiment, inner end faces 46*a* of the left and right damming members 46 are set to positions that are spaced inward from the respective end portions Da and Aa of the single-face corrugated cardboard sheet D and the bottom liner board A by a predetermined length, and inner end faces 45*a* of the scraping members 45 are set to positions that are spaced inward from the respective end portions Da and Aa of the single-face corrugated cardboard sheet D and the bottom liner board A by a predetermined length. However, the positions of the inner end faces 45*a* of the scraping members 45 may be positioned inside the inner end faces 46*a* of the damming members 46.

Here, the adhesive application region W of the single-face corrugated cardboard sheet D will be described in detail. As described above, the corrugating machine 10 manufactures the single-face corrugated cardboard sheet D by gluing the top liner board C to the corrugating medium B and manufactures the double-face corrugated cardboard sheet E by gluing the bottom liner board A to the single-face corrugated cardboard sheet D as shown in FIG. 8A. In this case, the single-face corrugated cardboard sheet D and the bottom liner board A are generally set to have the same width. In regard to the single-face corrugated cardboard sheet D and the bottom liner board A set as described above, the width of the adhesive application region W of the single-face corrugated cardboard sheet D to which an adhesive is applied by the adhesive application roller 43, that is, the damming width of the adhesive application roller 43 where the adhesive is dammed by the two damming members 46 is set to be smaller than the width of the bottom liner board A.

When the bottom liner board A is glued to the single-face corrugated cardboard sheet D and the bottom liner board A and the single-face corrugated cardboard sheet D are conveyed on the hot plate 35 of the heating section 20*a* in this state, adhesive liquid P is dried. When the adhesive liquid P is applied outside the adhesive application region W at this time, the adhesive liquid P is extruded from the end portions of the bottom liner board A in the width direction and the adhesive liquid P is applied to the hot plate 35 and solidified. Since the damming width of the adhesive application roller 43 (the adhesive application region W of the single-face corrugated cardboard sheet D) is set by the two damming members 46 in this embodiment, the extrusion of the adhesive liquid P from the bottom liner board A is prevented.

Further, the single-face corrugated cardboard sheet D and the bottom liner board A are set to have the same width as shown in FIG. 8B. However, when the width of the adhesive application region W of the single-face corrugated cardboard sheet D to which the adhesive is applied by the adhesive application roller 43, that is, the damming width of the adhesive application roller 43 where the adhesive is dammed by the two damming members 46 is set to be smaller than the width of the bottom liner board A even if the single-face corrugated cardboard sheet D and the bottom liner board A are conveyed while being shifted relative to each other in the width direction, the extrusion of the adhesive liquid P from the bottom liner board A is prevented.

Furthermore, when a double-face corrugated cardboard sheet E is changed to a double-face corrugated cardboard sheet E having a different width during the manufacture of the double-face corrugated cardboard sheet E, any one of the single-face corrugated cardboard sheet D (the corrugating medium B and the top liner board C) and the bottom liner board A may be used without change to manufacture the double-face corrugated cardboard sheet E in a case in which the number of double-face corrugated cardboard sheets to be manufactured is small. In this case, the width of the bottom liner board A is larger than the width of the single-face corrugated cardboard sheet D as shown in FIG. 8C. Even in this case, when the width of the adhesive application region W of the single-face corrugated cardboard sheet D to which the adhesive is applied by the adhesive application roller 43, that is, the damming width of the adhesive application roller 43 where the adhesive is dammed by the two damming members 46 is set to be smaller than the width of the bottom liner board A, the extrusion of the adhesive liquid P from the bottom liner board A is prevented.

Conversely, even if the width of the bottom liner board A is smaller than the width of the single-face corrugated cardboard sheet D as shown in FIG. 8D, the extrusion of the adhesive liquid P from the bottom liner board A is prevented when the width of the adhesive application region W of the single-face corrugated cardboard sheet D to which the adhesive is applied by the adhesive application roller 43, that is, the damming width of the adhesive application roller 43 where the adhesive is dammed by the two damming members 46 is set to be smaller than the width of the bottom liner board A.

The damming member 46 is formed in the shape of a block, and includes a first curved contact surface 71 that is provided at the tip portion thereof, has a predetermined width in the axial direction of the adhesive application roller 43, has a predetermined length in the circumferential direction of the adhesive application roller 43, and comes into surface contact with the surface of the adhesive application roller 43. The first curved contact surface 71 is set to have substantially the same radius of curvature as the surface of the adhesive application roller 43, and extends to a nip portion N between the adhesive application roller 43 and the doctor roller 44.

Further, the damming member 46 includes a second curved contact surface 72 that is provided at the tip portion thereof, has a predetermined width in the axial direction of the doctor roller 44, has a predetermined length in the circumferential direction of the doctor roller 44, and comes into surface contact with the surface of the doctor roller 44.

The second curved contact surface 72 is set to have substantially the same radius of curvature as the surface of the doctor roller 44, and extends to a nip portion N between the adhesive application roller 43 and the doctor roller 44.

For this reason, since the first curved contact surface 71 is formed at a portion of the damming member 46 facing the adhesive application roller 43 and the second curved contact surface 72 is formed at a portion of the damming member 46 facing the doctor roller 44, the tip portion of the damming member 46 is formed in a tapered shape having a predetermined width in the axial direction of each of the rollers 43 and 44. In this case, the first and second curved contact surfaces 71 and 72 have the same width. Meanwhile, a tip, which has a tapered shape, of the damming member 46 extends to the nip portion N between the adhesive application roller 43 and the doctor roller 44, but ends in front of the nip portion N in manufacturing. Accordingly, a clearance is secured between the nip portion N and the tip of the damming member 46.

Further, the damming member 46 is made of, for example, MC nylon (a trade name of Quadrant Polypenco Japan Ltd) as polyamide synthetic fiber. Meanwhile, the damming member 46 is not limited to the MC nylon, and may be made of a resin such as a high-molecular compound (plastic, elastomer, or urethane). In this case, the entire damming member 46 does not need to be made of a resin, and a resin layer (a fluorine resin layer or the like) may be formed on the contact surfaces (the first and second curved contact surfaces 71 and 72) that come into contact with the adhesive application roller 43 and the doctor roller 44. That is, when the adhesive application roller 43 or the doctor roller 44 is made of metal and the damming member 46 is made of a resin, the wear of the surface of the adhesive application roller 43 or the doctor roller 44 is prevented.

Furthermore, the damming member 46 includes a narrow mounting portion 74 that is formed at a body portion 73 where the first and second curved contact surfaces 71 and 72 are formed at the base end portion, and is formed integrally with a pair of restricted portions 75 that protrude upward and downward in a height direction. Meanwhile, a pair of locking portions 81 are formed at upper and lower portions of the tip portion of the support arm 66, and the support arm 66 includes an accommodation opening 82 that passes therethrough in a horizontal direction. The mounting portion 74 of the damming member 46 is positioned between the upper and lower locking portions 81, the pair of restricted portions 75 are positioned in the accommodation opening 82, and compression coil springs (biasing members) 84 are provided between two recesses 76 formed at the mounting portion 74 and two recesses 83 formed at the accommodation opening 82. Moreover, while the base end portion of the damming member 46 is supported by the tip portion of the support arm 66, a pair of (left and right) fixing plates 85 are disposed at the tip portion of the support arm 66 and are fixed by a plurality of bolts 86.

In this case, the damming member 46 is supported so as to be slidable in a direction which is orthogonal to the axial directions of the adhesive application roller 43 and the doctor roller 44 and in which the damming member 46 is adjacent to the adhesive application roller 43 and the doctor roller 44. That is, the restricted portions 75 of the damming member 46 are restricted in the accommodation opening 82, but the first and second curved contact surfaces 71 and 72 are supported so as to be movable by a predetermined distance in a direction in which the first and second curved contact surfaces 71 and 72 approach and are separated from the surfaces of the adhesive application roller 43 and the doctor roller 44. Further, the damming member 46 is biased in a direction, in which the first and second curved contact surfaces 71 and 72 are pressed against the surfaces of the adhesive application roller 43 and the doctor roller 44, by a biasing force of the compression coil spring 84. Furthermore, the damming member 46 is supported by the pair of (left and right) fixing plates 85 so as not to oscillate in the width direction, that is, in the axial direction of each of the rollers 43 and 44. Moreover, since two compression coil springs 84 are arranged in parallel between the damming member 46 and the support arm 66 in the vertical direction, the tip portions (the first and second curved contact surfaces 71 and 72) can oscillate about the base end portion (the mounting portion 74) as a fulcrum in the vertical direction, that is, in a direction of an arrow R of FIG. 4 toward the surface of the adhesive application roller 43 or the surface of the doctor roller 44.

For this reason, the damming member 46 is supported so that the first curved contact surface 71 is pressed against the surface of the adhesive application roller 43 and the second curved contact surface 72 is pressed against the surface of the doctor roller 44. Further, the first and second curved contact surfaces 71 and 72 of the damming member 46 oscillate relative to the surfaces of the adhesive application roller 43 and the doctor roller 44, so that the first and second curved contact surfaces 71 and 72 come into close contact with the surfaces of the adhesive application roller 43 and the doctor roller 44.

Furthermore, a mounting surface 91 is formed at a lower portion of the body portion 73, that is, a portion of the body portion 73 below the first curved contact surface 71. A base end portion of the scraping member 45 comes into close contact with the mounting surface 91 and an end portion thereof comes into close contact with a stepped portion 92, so that the damming member 46 is positioned. Moreover, while the base end portion of the scraping member 45 is interposed between the mounting surface 91 and a pressing member 93, a fixing bolt 94 passes through the pressing member 93, the scraping member 45, and the damming member 46 from below and is threadedly engaged with a nut 95. Accordingly, the scraping member 45 is fixed to the damming member 46.

The scraping member 45 has the shape of a flat plate, and has a predetermined width in the axial direction of the adhesive application roller 43. Further, since the scraping member 45 is made of a resin such as urethane (or plastic or elastomer), the scraping member 45 can be elastically deformed. Accordingly, while the scraping member 45 is fixed to the damming member 46, the tip portion of the scraping member 45 is pressed against the surface of the adhesive application roller 43. In this case, since the scraping member 45 comes into contact with the surface of the adhesive application roller 43 while having an angle θ of attack relative to a tangent to the adhesive application roller 43, substantially all of an adhesive film applied to the adhesive application roller 43 can be scraped off. Meanwhile, it is preferable that the angle θ of attack satisfies "$30° \leq \theta \leq 60°$", and it is possible to appropriately remove the adhesive film of the adhesive application roller 43 by setting the angle θ of attack to this range.

Further, an opening 77 formed along the width direction is formed at the damming member 46 on the downstream side of the scraping member 45 in the rotational direction of the adhesive application roller 43, that is, between the scraping member 45 and the first curved contact surface 71, so that a deformation region of the damming member 46 is secured.

Incidentally, as shown in FIG. 9, the adhesive application device 41 is provided with a circulation path for allowing adhesive liquid, which falls down from a predetermined clearance between the adhesive application roller 43 and the bottom plate 53, and adhesive liquid, which overflows the regulating plate 55, to be filtered and to return to the adhesive liquid tank 42. That is, since the storage pan 58 is disposed below the adhesive liquid tank 42, adhesive liquid falling down from a predetermined clearance between the adhesive application roller 43 and the bottom plate 53 is stored in the storage pan 58. The storage pan 58 is provided with a discharge port 101, and is connected to a primary tank 104 through a first discharge path 103 that includes a filter 102. Further, the adhesive liquid tank 42 includes a discharge port 105 that is formed at a position where adhesive liquid overflows the regulating plate 55, and is connected to the primary tank 104 through a second discharge path 107 that includes a filter 106.

The primary tank 104 is connected to a storage tank 110 through a connection path 109 that includes a pump 108. Furthermore, the storage tank 110 is connected to a supply port 114 of the adhesive liquid tank 42 through a supply path 113 that includes a filter 111 and a pump 112. In this case, the first discharge path 103, the second discharge path 107, the connection path 109, the supply path 113, and the like form the circulation path.

In this case, the pump 112 supplies a predetermined amount of adhesive liquid of the storage tank 110 to the adhesive liquid tank 42 through the supply path 113. That is, since the adhesive application roller 43 supplies adhesive liquid of which the amount is slightly larger than the amount of adhesive liquid to be scraped off, the adhesive liquid of the adhesive liquid tank 42 is made to always overflow the regulating plate 55. Accordingly, a constant amount of adhesive liquid is stored in the adhesive liquid tank 42.

Here, a method of applying an adhesive to the single-face corrugated cardboard sheet D by the adhesive application device 41 of this embodiment will be described.

The method of applying an adhesive by the adhesive application device 41 of this embodiment includes: a step of applying adhesive liquid to the surface of the adhesive application roller 43 through the rotation of the adhesive application roller 43; a step of scraping off the adhesive liquid, which is applied to the single-face corrugated cardboard sheet D outside the adhesive application region W, by making the scraping members 45 come into pressure contact with the surface of the adhesive application roller 43; a step of damming adhesive liquid, which is extruded from the adhesive application region W, by making the damming members 46 come into contact with the surface of the adhesive application roller 43; a step of adjusting the thickness of the adhesive liquid, which is applied to the adhesive application region W of the adhesive application roller 43, to a preset thickness by the doctor roller 44; and a step of transferring the adhesive liquid, which is applied to the surface of the adhesive application roller 43, to the single-face corrugated cardboard sheet D.

That is, as shown in FIGS. 2 and 4, the adhesive application roller 43 is rotationally driven in the clockwise direction in FIG. 2 and the doctor roller 44 is rotationally driven in the clockwise direction in FIG. 2 by the drive unit. At this time, the single-face corrugated cardboard sheet D is fed between the adhesive application roller 43 and the rider roller 47, so that the rider roller 47 is rotated in the counterclockwise direction in FIG. 2.

When the adhesive application roller 43 is rotated at this time, adhesive liquid stored in the adhesive liquid tank 42 is applied to the surface of the adhesive application roller 43. When the adhesive application roller 43 is further rotated, first, the scraping members 45 scrape off the adhesive liquid that is applied to the single-face corrugated cardboard sheet D outside the adhesive application region W since coming into pressure contact with the surface of the adhesive application roller 43 at the end portions of the adhesive application roller 43 in the axial direction. After that, when the adhesive application roller 43 is further rotated, the damming members 46 dam the adhesive liquid that is extruded from the adhesive application region W since coming into contact with the surface of the adhesive application roller 43 at the end portions of the adhesive application roller 43 in the axial direction. In this case, the damming members 46 prevent the adhesive liquid of the adhesive application region W, which is applied to the surface of the adhesive application roller 43, from being extruded to the outside of the adhesive application region W at the end portions of the adhesive application roller 43 in the axial direction, to the nip portion between the adhesive application roller 43 and the doctor roller 44.

Meanwhile, at this time, the width of the adhesive application region W of the single-face corrugated cardboard sheet D to which the adhesive is applied by the adhesive application roller 43, that is, the damming width of the adhesive application roller 43 where the adhesive is dammed by the two damming members 46 is set to be smaller than the width of the bottom liner board A according to the width of the bottom liner board A. As shown in FIGS. 1 and 3, the glue machine 19 is provided with a sensor 19*a* that detects the width of the bottom liner board A to be conveyed, and the sensor 19*a* outputs the detected width of the bottom liner board A to a controller 37. Then, the controller 37 moves the scraping members 45 and the damming members 46 to predetermined positions through the support arms 66 by driving the drive motor 63 according to the width of the bottom liner board A and moving the moving plate 60. These predetermined positions are positions where the width of the adhesive application region W of the single-face corrugated cardboard sheet D is set to be smaller than the width of the bottom liner board A as described above.

In this case, the corrugating machine is adapted so that the glue machine 19 is provided with the sensor 19*a* detecting the width of the bottom liner board A and the controller 37 moves the scraping members 45 and the damming members 46 to predetermined positions according to the width of the bottom liner board A, but the corrugating machine is not limited to this structure. For example, since a production management device has various data that includes not only the width of the bottom liner board A but also the width of the corrugating medium B or the top liner board C, the corrugating machine may be adapted so that the production management device moves the scraping members 45 and the damming members 46 to predetermined positions according to the width of the bottom liner board A.

Further, the doctor roller 44 adjusts the thickness of the adhesive liquid, which is applied to the adhesive application region W of the adhesive application roller 43, to a preset thickness at the nip portion between the adhesive application roller 43 and the doctor roller 44. After that, the adhesive liquid, which is applied to the surface of the adhesive application roller 43, is transferred to the apex portions of the corrugated portions of the single-face corrugated cardboard sheet D at a nip portion between the adhesive application roller 43 and the rider roller 47.

As described above, the web adhesive application device of this embodiment includes: the adhesive liquid tank 42 that can store adhesive liquid; the adhesive application roller 43 that allows the adhesive liquid of the adhesive liquid tank 42 to be applied to a surface thereof and can transfer the adhesive liquid to the adhesive application region W adjusted according to the width of the bottom liner board A to be glued to the single-face corrugated cardboard sheet D; the doctor roller 44 that can adjust the thickness of the adhesive liquid applied to the adhesive application roller 43 to a set thickness; the scraping members 45 that scrape off the adhesive liquid, which is applied outside the adhesive application region W, by coming into pressure contact with the surface of the adhesive application roller 43 on the upstream side of the nip portion between the adhesive application roller 43 and the doctor roller 44 in the rotational direction; and the damming members 46 that dam the adhesive liquid, which is extruded from the adhesive application region W, by coming into contact with the surface of the adhesive application roller 43 on the upstream side of the nip portion between the adhesive application roller 43 and the doctor roller 44 in the rotational direction and on the downstream side of the contact positions of the scraping members 45 in the rotational direction.

Accordingly, when the adhesive liquid of the adhesive liquid tank 42 is applied to the surface of the adhesive application roller 43 through the rotation of the adhesive application roller 43, first, the scraping members 45 scrape off the adhesive liquid, which is applied outside the adhesive application region W, by coming into pressure contact with the surface of the adhesive application roller 43, the damming members 46 then dam the adhesive liquid, which is extruded from the adhesive application region W, by coming into contact with the surface of the adhesive application roller 43, and the doctor roller 44 transfers the adhesive liquid, which is applied to the surface of the adhesive application roller 43, to the apex portions of the corrugated portions of the single-face corrugated cardboard sheet D after adjusting the thickness of the adhesive liquid, which is applied to the adhesive application region W of the adhesive application roller 43, to a set thickness.

That is, after the scraping members 45 scrape off the adhesive liquid, which is applied to the adhesive application roller 43 outside the adhesive application region W, the damming members 46 dam the adhesive liquid that is extruded from the adhesive application region W. Accordingly, the extrusion of the adhesive liquid from the adhesive application region W to the end portions of the adhesive application roller 43 in the axial direction is prevented, so that the adhesive liquid is appropriately applied to the single-face corrugated cardboard sheet D by the adhesive application roller 43. For this reason, when the single-face corrugated cardboard sheet D and the bottom liner board A are sent to the double facer 20 and travel on the hot plate 35, the extrusion of the adhesive liquid from the end portions of the bottom liner board A in the width direction, the application of the adhesive liquid to the hot plate 35, and the solidification of the adhesive liquid on the hot plate 35 can be prevented.

In the web adhesive application device of this embodiment, the damming member 46 includes the first curved contact surface 71 that has a predetermined width in the axial direction of the adhesive application roller 43, has a predetermined length in the circumferential direction of the adhesive application roller 43, and comes into contact with the surface of the adhesive application roller 43, and the first curved contact surface 71 extends to the nip portion between the adhesive application roller 43 and the doctor roller 44. Accordingly, since the first curved contact surface 71 can dam the adhesive liquid, which is applied to the adhesive application region W, in a region to the nip portion between the adhesive application roller 43 and the doctor roller 44, it is possible to prevent the adhesive liquid from being extruded from the adhesive application region W when the thickness of the adhesive liquid is adjusted to a set thickness by the doctor roller 44.

In the web adhesive application device of this embodiment, the damming member 46 is provided with the second curved contact surface 72 that comes into contact with the surface of the doctor roller 44, and the second curved contact surface 72 extends to the nip portion between the adhesive application roller 43 and the doctor roller 44. Accordingly, the first curved contact surface 71 dams the adhesive liquid, which is applied to the adhesive application region W to the nip portion between the adhesive application roller 43 and the doctor roller 44, and the second curved contact surface 72 can prevent the adhesive liquid from being extruded from the adhesive application roller 43 to the doctor roller 44 when the doctor roller 44 adjusts the thickness of the adhesive liquid to a set thickness.

In the web adhesive application device of this embodiment, the scraping member 45 can be elastically deformed and the opening 77 is formed between the scraping member 45 and the damming member 46, so that the deformation region is secured. Accordingly, when the scraping member 45 scrapes off the adhesive liquid applied outside the adhesive application region W by coming into pressure contact with the surface of the adhesive application roller 43, the scraping member 45 is elastically deformed. However, since the opening (deformation region) 77 is formed at the damming member 46, the scraping member 45 enters the opening 77 and can appropriately scrape off the adhesive liquid, which is applied to the surface of the adhesive application roller 43, without coming into contact with the damming member 46.

In the web adhesive application device of this embodiment, the damming member 46 is supported so as to be pressed against the surface of the adhesive application roller 43. Accordingly, since the damming member 46 can come into close contact with the surface of the adhesive application roller 43 without a clearance, the damming member 46 can prevent the adhesive liquid from being extruded from the adhesive application region W. Further, even if the contact surface of the damming member 46 coming into contact with the adhesive application roller 43 is worn out, the damming member 46 can always come into close contact with the surface of the adhesive application roller 43. Accordingly, the damming member 46 can prevent the adhesive liquid from being extruded from the adhesive application region W for a long period of time.

In this case, two compression coil springs 84, which press the damming member 46 against the surface of the adhesive application roller 43, are provided. Accordingly, the damming member 46 can stably come into close contact with the surface of the adhesive application roller 43, so that the damming member 46 can prevent the adhesive liquid from being extruded from the adhesive application region W.

Furthermore, the damming member 46 is supported so as to be slidable in a direction which is orthogonal to the axial directions of the adhesive application roller 43 and the doctor roller 44 and in which the damming member 46 is adjacent to both the rollers 43 and 44. Accordingly, it is possible to make the damming member 46 appropriately come into contact with the surface of the adhesive application roller 43 regardless of a state in which the damming member 46, the adhesive application roller 43, or the like is mounted.

In the web adhesive application device of this embodiment, one end portion of the damming member 46 in the width direction corresponds to an end portion of the adhesive application region W in the width direction and one end portion of the scraping member 45 corresponds to an end portion of the adhesive application region W in the width direction or extends within the adhesive application region W by a predetermined length. Accordingly, since one end portion of the damming member 46 and one end portion of the scraping member 45 correspond to the end portion of the adhesive application region W in the width direction, the scraping member 45 can appropriately scrape off the adhesive liquid that is applied outside the adhesive application region W and the damming member 46 can appropriately prevent the adhesive liquid from being extruded from the adhesive application region W. Further, when one end portion of the scraping member 45 extends within the adhesive application region W, the scraping member 45 scrapes off not only the adhesive liquid outside the adhesive application region W but also the adhesive liquid of a part of the inside of the adhesive application region W. Accordingly, even though the scraping member 45 and the damming member 46 are spaced apart from each other by a predetermined distance, the damming member 46 can appropriately prevent the adhesive liquid from being extruded from the adhesive application region W.

In the web adhesive application device of this embodiment, a metal layer is formed on the surface of the adhesive application roller 46 and a resin layer is formed on the contact surface of the damming member 46. Accordingly, since the damming member 46 of which the surface is made of a resin comes into contact with the adhesive application roller 43 of which the surface is made of metal, damage to the surface of the adhesive application roller 43 is prevented. As a result, it is possible to appropriately prevent the adhesive liquid from being extruded from the adhesive application region W for a long period of time.

In the web adhesive application device of this embodiment, the scraping member 45 and the damming member 46 are supported by the same support arm 66. That is, the damming member 46 is fixed to the tip portion of the support arm 66, and the scraping member 45 is fixed to the lower portion of the damming member 46. Accordingly, since it is possible to improve the mountability of the scraping member 45 and the damming member 46 and to adjust the positions of the scraping member 45 and the damming member 46 by only adjusting the position of the support arm 66, it is possible to improve workability.

In the web adhesive application device of this embodiment, the base end portion of the support arm 66 can be positioned relative to the moving plate 60 by three support faces along the directions that cross each other. That is, the lower surface of the mounting portion 66*a* is placed on the placement surface 60*a* of the moving plate 60, the stepped portion 66*b* comes into contact with the end face 60*b* of the moving plate 60, and the mounting portion 66*a* comes into contact with the vertical wall surfaces 60*c*, so that the support arm 66 is positioned in the three directions. Since the scraping member 45 and the damming member 46 can be easily positioned through the support arms 66, it is possible to improve positioning accuracy and mounting workability.

In the web adhesive application device of this embodiment, the device frame 52 is provided with the moving plate 60 that is movable in the axial direction of the adhesive application roller 43 and the support arm 66 is supported by the moving plate 60. Accordingly, since the positions of the scraping member 45 and the damming member 46 can be easily changed according to the width of the bottom liner board A, versatility can be improved.

In the web adhesive application device of this embodiment, the adhesive liquid tank 42 includes the bottom plate 53 of which one end portion is disposed with a predetermined clearance interposed between itself and the surface of the adhesive application roller 43, the pair of side plates 54 which are connected to both side portions of the bottom plate 53 and of which each of one end portions is disposed so as to be pressed against the surface of the adhesive application roller 43, and the regulating plate 55 that is connected to the other end portion of the bottom plate 53 and allows the stored adhesive liquid to overflow; and the storage pan 58 is disposed below the adhesive liquid tank 42. Accordingly, it is possible to simplify the structure of the adhesive liquid tank 42 and to reduce the amount of the adhesive liquid stored in the adhesive liquid tank 42. Therefore, it is possible to reduce operating costs. Further, since a predetermined clearance is formed between the bottom plate 53 and the adhesive application roller 43, it is possible to prevent damage to the surface of the adhesive application roller 43. In this case, the adhesive liquid of the adhesive liquid tank 42 flows downward from the clearance between the adhesive application roller 43 and the bottom plate 53 during the stop of the adhesive application roller 43, but the adhesive liquid having flowed downward is stored in the storage pan 58. Accordingly, adhesive liquid can be easily collected.

The web adhesive application device of this embodiment is provided with the circulation path for allowing adhesive liquid, which falls down from a predetermined clearance between the adhesive application roller 43 and the bottom plate 53, and adhesive liquid, which overflows the regulating plate 55, to be filtered by the filters 102 and 106 and to return to the adhesive liquid tank 42. Accordingly, since the adhesive liquid can be easily collected and foreign substances mixed with the adhesive liquid can be easily removed, stable work for applying an adhesive can be performed.

Further, the method of applying an adhesive to a web of this embodiment includes: a step of applying adhesive liquid to the surface of the adhesive application roller 43 through the rotation of the adhesive application roller 43; a step of scraping off the adhesive liquid, which is applied to the single-face corrugated cardboard sheet D outside the adhesive application region W, by making the scraping members 45 come into pressure contact with the surface of the adhesive application roller 43; a step of damming adhesive liquid, which is extruded from the adhesive application region W, by making the damming members 46 come into contact with the surface of the adhesive application roller 43; a step of adjusting the thickness of the adhesive liquid, which is applied to the adhesive application region W of the single-face corrugated cardboard sheet D of the adhesive application roller 43, to a preset thickness by the doctor roller 44; and a step of transferring the adhesive liquid, which is applied to the surface of the adhesive application roller 43, to the single-face corrugated cardboard sheet D.

Accordingly, after the scraping members 45 scrape off the adhesive liquid, which is applied to the adhesive application roller 43 outside the adhesive application region W, the damming members 46 dam the adhesive liquid that is extruded from the adhesive application region W. Therefore, the extrusion of the adhesive liquid from the adhesive application region W to the end portions of the adhesive application roller 43 in the axial direction is prevented, so that the adhesive liquid is appropriately applied to the single-face corrugated cardboard sheet D by the adhesive application roller 43. For this reason, when the single-face corrugated cardboard sheet D and the bottom liner board A are sent to the double facer 20 and travel on the hot plate 35, the extrusion of the adhesive liquid from the end portions of the bottom liner board A in the width direction, the application of the adhesive liquid to the hot plate 35, and the solidification of the adhesive liquid on the hot plate 35 can be prevented.

Further, the corrugated cardboard sheet manufacturing apparatus of this embodiment includes the single facer 15 that manufactures a single-face corrugated cardboard sheet D by gluing the top liner board C to the corrugating medium B, the glue machine 19 that applies adhesive liquid to the apex portions of the corrugated portions of the single-face corrugated cardboard sheet D, and the double facer 20 that manufactures a double-face corrugated cardboard sheet E by gluing the bottom liner board A to the corrugating medium B side of the single-face corrugated cardboard sheet D manufactured by the single facer 15; and the above-mentioned adhesive application device 41 is applied to the glue machine 19.

Accordingly, the single facer 15 manufactures the single-face corrugated cardboard sheet D by gluing the top liner board C to the corrugating medium B, the glue machine 19 applies adhesive liquid to the apex portions of the corrugated portions of the single-face corrugated cardboard sheet D, and the double facer 20 manufactures the double-face corrugated cardboard sheet E by gluing the bottom liner board A to the corrugating medium B side of the single-face corrugated cardboard sheet D. At this time, in the glue machine 19, the scraping members 45 scrape off the adhesive liquid, which is applied to the adhesive application roller 43 outside the adhesive application region W, and the damming members 46 then dam the adhesive liquid that is extruded from the adhesive application region W. Accordingly, the extrusion of the adhesive liquid from the adhesive application region W to the end portions of the adhesive application roller 43 in the axial direction is prevented, so that the adhesive liquid is appropriately applied to the single-face corrugated cardboard sheet D by the adhesive application roller 43. For this reason, when the single-face corrugated cardboard sheet D and the bottom liner board A are sent to the double facer 20 and travel on the hot plate 35, the extrusion of the adhesive liquid from the end portions of the bottom liner board A in the width direction, the application of the adhesive liquid to the hot plate 35, and the solidification of the adhesive liquid on the hot plate 35 can be prevented.

Meanwhile, in the above-mentioned embodiment, the damming member 46 has been mounted at the tip portion of the support arm 66 and the scraping member 45 has been mounted on the damming member 46. However, two support arms may be provided, and the damming member 46 and the scraping member 45 may be separately mounted at tip portions of different support arms.

Further, in the above-mentioned embodiment, the damming member 46 has been formed in the shape of a block. However, the shape of the damming member is not limited thereto and may be, for example, the shape of a plate as long as one end portion of the damming member can be positioned at the end portion of the adhesive application region of the adhesive application roller 43.

Furthermore, the web adhesive application device of this embodiment has been applied to the glue machine 19 in the above-mentioned embodiment, but may be applied to the adhesive application device **15*d* of the single facer 15**. Moreover, the web adhesive application device and the method of applying an adhesive to a web of this embodiment have been used to apply an adhesive to the apex portions of the corrugated portions of the single-face corrugated cardboard sheet D (corrugating medium B), but may be used to apply an adhesive to a flat web.

REFERENCE SIGNS LIST

10: corrugating machine (corrugated cardboard sheet manufacturing apparatus)
11: mill roll stand
12: preheater
13: mill roll stand
14: preheater
15: single facer
16: bridge
17: mill roll stand
18: preheater
19: glue machine (web adhesive application device)
20: double facer
21: rotary shears
22: slitter scorer
23: cutoff
24: stacker
41: adhesive application device
42: adhesive liquid tank
43: adhesive application roller
44: doctor roller
45: scraping member
46: damming member
47: rider roller
60: moving plate (moving member)
66: support arm (support member)
71: first curved contact surface
72: second curved contact surface
77: opening (deformation region)
84: compression coil spring (biasing member)
A: bottom liner board (first liner)
B: corrugating medium
C: top liner board (second liner)
D: single-face corrugated cardboard sheet (web)
E: double-face corrugated cardboard sheet

The invention claimed is:

1. A web adhesive application device comprising:

an adhesive liquid tank that stores adhesive liquid;

an adhesive application roller that allows the adhesive liquid of the adhesive liquid tank to be applied to a surface thereof and transfers the adhesive liquid to an adhesive application region of a web;

a doctor roller that adjusts a thickness of the adhesive liquid applied to the adhesive application roller to a preset thickness;

a scraping member that scrapes off the adhesive liquid, which is applied outside the adhesive application region, by coming into pressure contact with a surface of the adhesive application roller on an upstream side of a nip portion between the adhesive application roller and the doctor roller in a rotational direction; and a damming member that dams the adhesive liquid, which is extruded from the adhesive application region, by coming into contact with the surface of the adhesive application roller on the upstream side of the nip portion between the adhesive application roller and the doctor roller in the rotational direction and on a downstream side of a contact position of the scraping member in the rotational direction, wherein the damming member is provided with a first curved contact surface that has a predetermined width in an axial direction of the adhesive application roller, has a predetermined length in a circumferential direction of the adhesive application roller, and comes into contact with the surface of the adhesive application roller, the first curved contact surface extends to a nip portion between the adhesive application roller and the doctor roller, the damming member is provided with a second curved contact surface that comes into contact with a surface of the doctor roller, and the second curved contact surface extends to the nip portion between the adhesive application roller and the doctor roller.

2. The web adhesive application device according to claim 1, wherein the scraping member is elastically deformable, and a deformation region is formed between the scraping member and the damming member.

3. The web adhesive application device according to claim 1, wherein the damming member is supported so as to be pressed against the surface of the adhesive application roller.

4. The web adhesive application device according to claim 3, further comprising:

a plurality of biasing members that press the damming member against the surface of the adhesive application roller.

5. The web adhesive application device according to claim 1, wherein the damming member is supported so as to be slidable in a direction which is orthogonal to axial directions of the adhesive application roller and the doctor roller and in which the damming member is adjacent to the adhesive application roller and the doctor roller.

6. The web adhesive application device according to claim 1, wherein the damming member has a predetermined width in the axial direction of the adhesive application roller, and one end portion of the damming member in a width direction corresponds to an end portion of the adhesive application region in the width direction, and the scraping member has a predetermined width in the axial direction of the adhesive application roller, and one end portion of the scraping member in the width direction corresponds to an end portion of the adhesive application region in the width direction or extends within the adhesive application region by a predetermined length.

7. The web adhesive application device according to claim 1, wherein a metal layer is provided on the surface of the adhesive application roller, and a resin layer is formed on the contact surface of the damming member.

8. The web adhesive application device according to claim 1, wherein the scraping member and the damming member are supported by the same support member.

9. The web adhesive application device according to claim 8, wherein the support member is positioned relative to a device frame by three support faces along directions that cross each other.

10. The web adhesive application device according to claim 8, wherein a device frame is provided with a moving member that is movable in the axial direction of the adhesive application roller, and the support member is supported by the moving member.

11. The web adhesive application device according to claim 10, wherein the web is a single-face corrugated cardboard sheet in which a second liner is glued to a corrugating medium, and the damming member is disposed inside a position of an end portion of a first liner, which is glued to the corrugating medium of the single-face corrugated cardboard sheet, in the width direction by the moving member.

12. The web adhesive application device according to claim 11, wherein the position of the end portion of the first liner in the width direction is output from a production management device.

13. The web adhesive application device according to claim 11, wherein the position of the end portion of the first liner in the width direction is output from a sensor that detects the end portion of the first liner in the width direction.

14. The web adhesive application device according to claim 1, wherein the adhesive liquid tank includes a bottom plate, one end portion of the bottom plate being disposed with a predetermined clearance interposed between the bottom plate and the surface of the adhesive application roller, a pair of side plates which are connected to both side portions of the bottom plate, one end portions of each side plate being disposed so as to be pressed against the surface of the adhesive application roller, and a regulating plate that is connected to the other end portion of the bottom plate and allows the stored adhesive liquid to overflow, and a storage pan is disposed below the adhesive liquid tank.

15. The web adhesive application device according to claim 14, further comprising:

a circulation path allowing adhesive liquid, which falls down from the adhesive liquid tank through a predetermined clearance between the adhesive application roller and the bottom plate, and adhesive liquid, which overflows the regulating plate, to be filtered and to return to the adhesive liquid tank.

16. A method of applying an adhesive to a web, the method comprising the steps of:

applying adhesive liquid to a surface of an adhesive application roller through a rotation of the adhesive application roller;

scraping off adhesive liquid, which is applied outside a web adhesive application region, by making a scraping member come into pressure contact with the surface of the adhesive application roller;

damming adhesive liquid, which is extruded from the adhesive application region, by making a damming member come into contact with the surface of the adhesive application roller;

adjusting a thickness of the adhesive liquid, which is applied to the web adhesive application region of the adhesive application roller, to a preset thickness by a doctor roller; and transferring the adhesive liquid, which is applied to the surface of the adhesive application roller, to the web, wherein the damming member is provided with a first curved contact surface that has a predetermined width in an axial direction of the adhesive application roller, has a predetermined length in a circumferential direction of the adhesive application roller, and comes into contact with the surface of the adhesive application roller, the first curved contact surface extends to a nip portion between the adhesive application roller and the doctor roller, the damming member is provided with a second curved contact surface that comes into contact with a surface of the doctor roller, and the second curved contact surface extends to the nip portion between the adhesive application roller and the doctor roller.

17. A corrugated cardboard sheet manufacturing apparatus comprising:

a single facer that manufactures a single-face corrugated cardboard sheet by gluing a second liner to a corrugating medium;

a glue machine that applies adhesive liquid to apex portions of corrugated portions of the single-face corrugated cardboard sheet; and a double facer that manufactures a double-face corrugated cardboard sheet by gluing a first liner to a corrugating medium side of the single-face corrugated cardboard sheet, wherein the glue machine is provided with the web adhesive application device according to claim 1.

* * * * *